US006042088A

United States Patent [19]

Wang

[11] Patent Number: 6,042,088

[45] Date of Patent: Mar. 28, 2000

[54] CHANGEABLE VENTURI CARBURETOR INCLUDING A COLD START AND HIGH LOADING AUXILIARY FUEL DUCT

[75] Inventor: Ming-Ching Wang, Taipei, Taiwan

[73] Assignee: Wen-Hsien Huang, Taipei, Taiwan

[21] Appl. No.: 09/086,144

[22] Filed: May 27, 1998

[51] Int. Cl.[7] ..... F02M 1/10

[52] U.S. Cl. ..... 261/39.1; 261/39.3; 261/69.1

[58] Field of Search ..... 261/39.1, 69.1, 261/39.3, 52, 64.3, 50.1, 50.2, DIG. 74

[56] References Cited

U.S. PATENT DOCUMENTS

| | | | |
|---|---|---|---|
| 3,877,448 | 4/1975 | Schmid | 261/39.1 X |
| 3,921,612 | 11/1975 | Aono | 261/39.1 X |
| 4,005,690 | 2/1977 | Hirosawa et al. | 261/39.3 X |
| 4,128,086 | 12/1978 | Garcea | 261/64.3 X |
| 4,132,211 | 1/1979 | Wilfert et al. | 261/50.2 X |
| 4,168,680 | 9/1979 | Kawai et al. | 261/39.1 |
| 4,226,814 | 10/1980 | Dirda | 261/39.3 |
| 4,297,981 | 11/1981 | Kimata et al. | 261/50.2 X |
| 4,298,549 | 11/1981 | Woodworth | 261/39.3 |
| 4,298,550 | 11/1981 | Hayashi | 261/39.1 X |
| 4,393,838 | 7/1983 | Muscatell | 261/50.2 X |
| 4,434,111 | 2/1984 | Teramura et al. | 261/DIG. 74 |
| 4,517,134 | 5/1985 | Nakamura et al. | 261/DIG. 74 |

*Primary Examiner*—Richard L. Chiesa
*Attorney, Agent, or Firm*—W. Wayne Liauh

[57] ABSTRACT

A changeable Venturi carburetor includes an auxiliary fuel which has a vacuum valve and a temperature delay vacuum valve. The vacuum valve has a third air nozzle connecting with a second air nozzle in the temperature delay vacuum which further has a first air nozzle communicating with the main throttle of the carburetor. Through the temperature delay vacuum valve, air pressure at the main throttle will be transmitted to the vacuum valve which then controls auxiliary fuel supply to increase engine output power. As a result, engine cold start may be done easily and smoothly, and warm up done in a short period of time. It can also increase engine power by providing additional fuel to the engine during sudden acceleration or high situation.

5 Claims, 5 Drawing Sheets

CHANGEABLE VENTURI CARBURETOR INCLUDING A COLD START AND HIGH LOADING AUXILIARY FUEL DUCT

BACKGROUND OF THE INVENTION

1. Field of the Invention

This invention relates to a carburetor for vehicle and particularly to a changeable venturi carburetor with cold start and high loading auxiliary fuel duct that can automatically supply additional fuel gas into the engine to provide extra power when needed.

2. Description of the Prior Art

The function and purpose of carburetors in (automobile or motorcycle) is to provide appropriate fuel gas mixture for engine to generate power needed at different work load conditions. Conventional carburetor includes a Venturi tube. When air flows through the Venturi throat, airflow speed increases and results in vacuum effect. Fuel nozzle sucks in fuel. Fuel is then vaporized to mix up with air for engine combustion use.

When a vehicle is under cold start situation, it needs rich fuel gas mixture to start the engine. Conventional vehicles use the throttling method and means to meet this need. It is not very satisfactory, particularly in winter time when temperature is low. It often happens that the vehicle is difficult to start, or the engine does not run smoothly and will take a long time to warm up. It is time consuming, causes fuel waste and creates air pollution as combustion in the engine usually is not completed during cold start and warm up period.

Another situation is when the vehicle is in motion but needs sudden high power such as abrupt acceleration or climbing a high slope road. Hitting the accelerator heavily and suddenly trying to get extra power needed will result in a vacuum drop in the engine and creating a situation wherein cannot provide adequate fuel gas mixture for engine combustion. Engine output will drop. Total engine displacement will be impacted and results in poor engine performance. These shortcomings indicated that improvements are needed.

SUMMARY OF THE INVENTION

It is therefore an object of this invention to provide a changeable Venturi carburetor which includes cold start and high loading auxiliary fuel duct that can provide the engine with additional fuel gas mixture during cold start time or when the accelerator is pushed suddenly for abrupt acceleration or high loading situations so that the engine will generate more power to meet the needs.

The changeable Venturi carburetor according to this invention has a changeable Venturi tube with a butterfly valve located therein, a main fuel duct which includes a main throttle and a fuel pin, and an auxiliary fuel duct which includes a vacuum valve and a temperature delay vacuum valve.

The vacuum valve controls fuel supply of the auxiliary fuel duct. The temperature delay vacuum valve opens the auxiliary fuel duct during cold start time to speed up engine warm up. When the accelerator is hit suddenly and forcefully for high loading or instant acceleration situation, the vacuum valve also will be opened to provide additional fuel gas mixture to enable the engine to produce greater power output.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
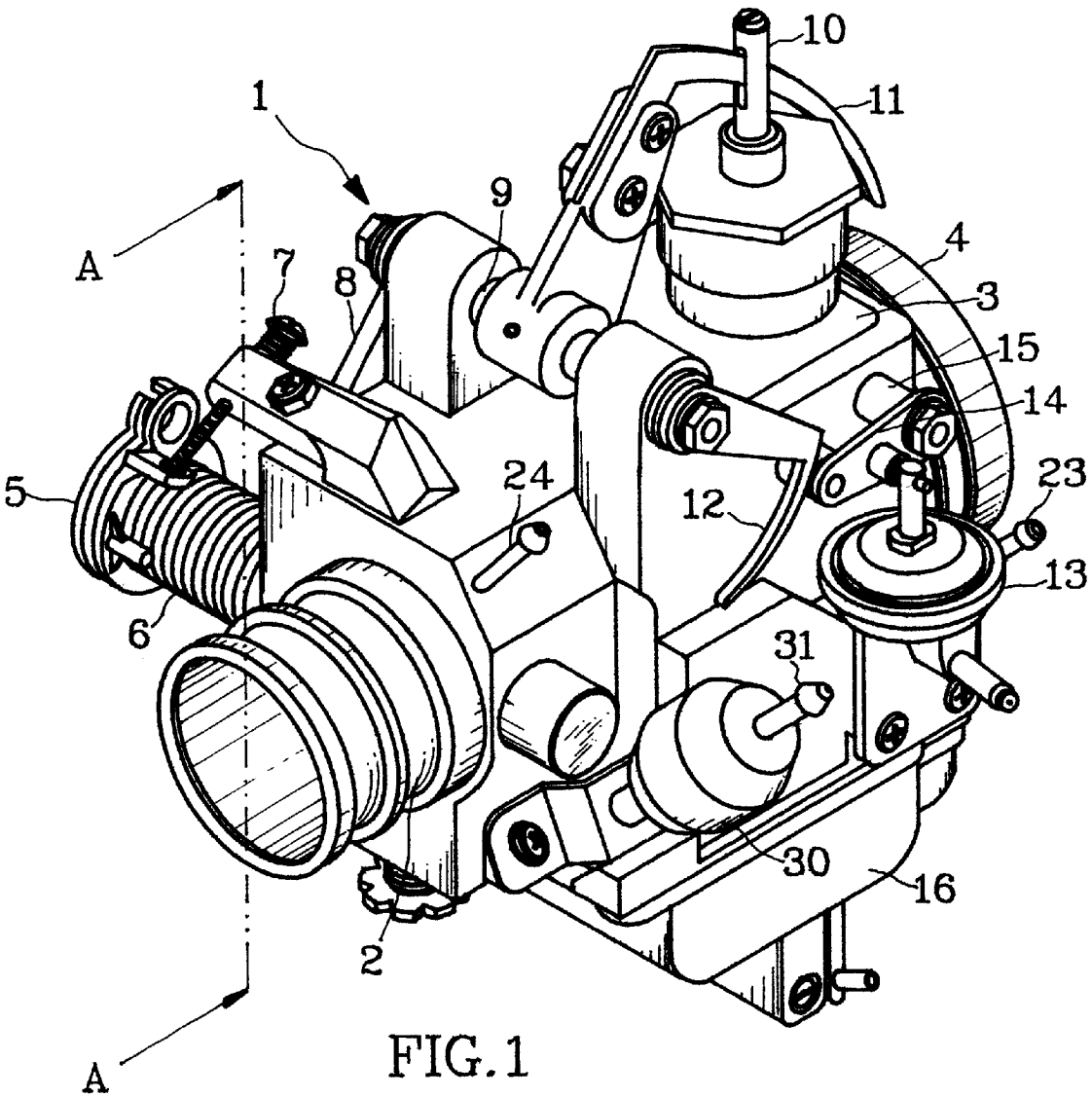
FIG. 1 is a perspective view of this invention in use.
Figure 2:
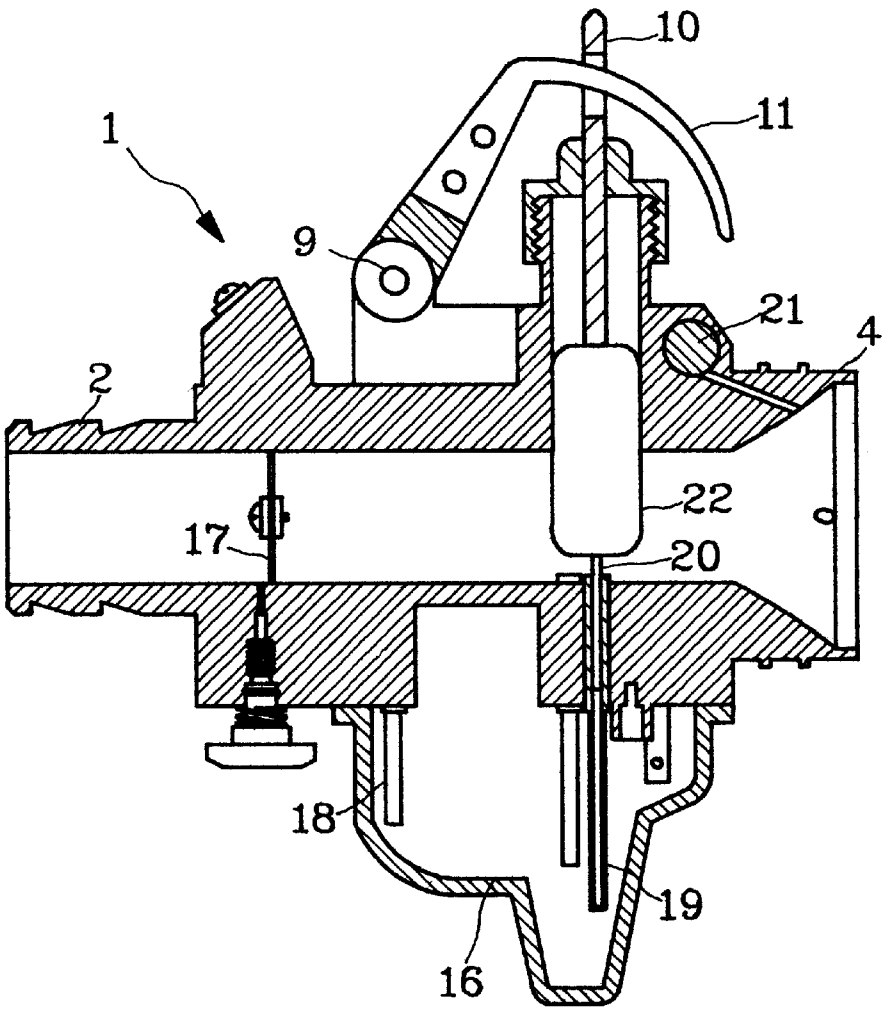
FIG. 2 is a sectional view taken across line A—A of FIG. 1.

Referring to FIGS. 1 and 2, the carburetor 1 according to this invention includes a front frame 2, a body 3, a back frame 4 and a float chamber 16. The body 3 includes at least a Venturi means which includes a steel rope wheel 5 and a butterfly valve 17, a main fuel system which includes a main throttle 22 and a fuel pin 20, and an auxiliary fuel duct of this invention which includes a vacuum valve 30 and a temperature delay vacuum valve 50 (also shown in FIG. 5).

The spindle of the steel rope wheel 5 engages with the butterfly valve 17. The steel rope wheel 5 further links and drives a first shaft 9 through a link 8. The first shaft 9 has a first cam 11 and a second cam 12 fixed thereon. The first cam 11 engages with a main throttle link 10 for controlling the open or close of the main throttle 22. Below the main throttle 22, there is the fuel pin 20 for controlling fuel gas supply to the engine.

The second cam 12 makes contact with one end of a rocker arm 14 which is pivotally rotatable at another end about a second shaft 15. The second shaft 15 mounts in the carburetor 1 and engages with a tube throttle 21. The rocker arm 14 further engages with a valve 13 (may be a vacuum valve). The carburetor 1 further has an idling adjust knob 7 which has one end making contact with the steel rope wheel 5 for adjusting the initial position of the wheel 5. The wheel 5 engages with a torsion spring 6 which may make the wheel 5 to return to the initial position.

The steel rope wheel 5 may be turned by a steel rope (not shown in the figures) so that the butterfly valve 17 may be turned to change air flow quantity and speed. Then fuel air mixture supply will be changed and achieves the function of changeable Venturi.

When the steel rope wheel 8 is turned, the first shaft 9 is also turned via the link 8, therefore the first cam 111 and second cam 12 are also turned. The first cam 11 then moves the main throttle link 10 which in turn moves the main throttle 22 and fuel pin 20 for controlling main fuel duct system. The second cam 12 drives the rocket arm 14, then the second shaft 15 is turned and activates the tube throttle 21. Therefore during high speed (such as 60 km/hour for motorcycle) when the accelerator is fully opened (i.e. the wheel 5 being turned at a large angle), additional air may be entered into the carburetor 1 to meet the needs. The changeable Venturi main fuel duct system, tube throttle 21 and fuel ducts 18, 19 in the float chamber 16 are known in the arts and form no part of this invention, thus will be omitted hereunder.

The main characteristics of this invention is to provide a novel vacuum valve 30 and a temperature delay vacuum valve 50 in the carburetor 1 as an auxiliary fuel duct for vehicle cold start and high loading use. It is not an idling fuel duct of a conventional carburetor. The vacuum valve 30 aims at controlling fuel supply of the auxiliary fuel duct. The temperature delay vacuum valve 50 aims at activating the auxiliary fuel duct during engine cold start so that the engine can have enough fuel air mixture to start easily, run smoothly and warm up in a shorter period of time. After the engine is warmed up and runs smoothly, the vacuum valve 30 will be stopped to cut auxiliary fuel supply. During sudden acceleration or high loading situation and the accelerator is fully opened, the vacuum degree of the engine will drop, then the vacuum valve 30 will be opened automatically for providing additional fuel air mixture to increase engine output power.

Figure 3:
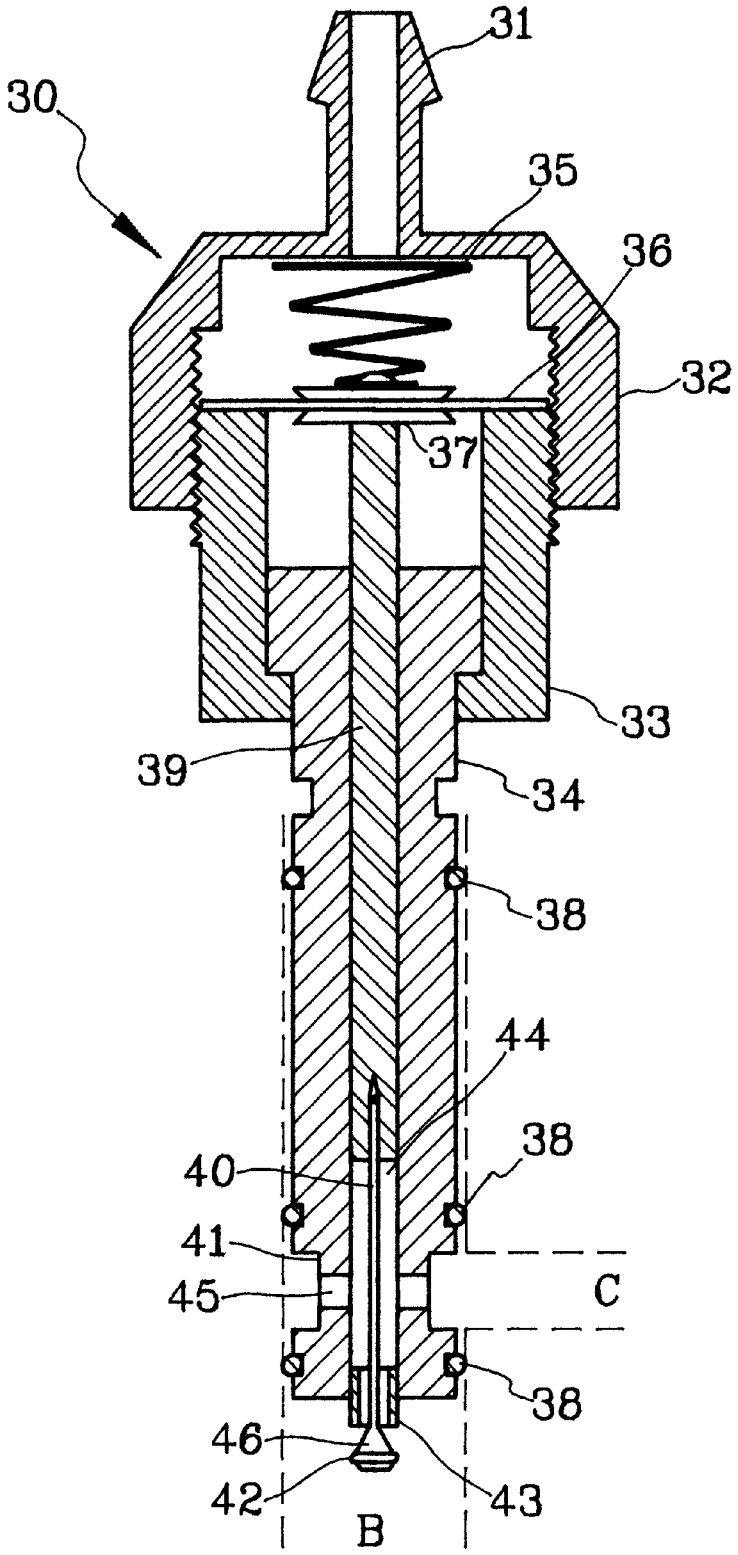
FIG. 3 is a sectional view of a vacuum valve of this invention.

Referring to FIG. 3, the vacuum valve 30 includes a top cover 32, an outside tube 34 and an inner stem 39. The top cover 32 has a third air nozzle 31 extending out of the top end thereof. The outside tube 34 has a membrane 36 (non-air-permeable type) sealed at the top end of its head 33. There is a clip 37 sandwiches the membrane 36 at the center portion. The head 33 then is screwed inside the top cover 32 and forms a head chamber between the top cover and the membrane 36. A first spring 35 is located in the head chamber with one end of the spring making contact with one side of the clip 37.

The outside tube 34 has a center bore 44 runs through a tail end thereof. The center bore 44 at the tail end engages with a plug ring 43. Above the tail end and spaced from the plug ring 43, there is an annular groove 41 formed on the outside tube 34. In the annular groove 41, at least one air passage 45 is formed to communicate with the center bore 44. Above and below the annular groove 41, there are a plural number of O-rings 38 engages with the outside tube 34.

The stem 39 has an outside diameter slightly less than the inside diameter of the center bore 44, and is moveably engaged with the center bore 44. The top end of the stem 39 engages with another side of the clip 37. The bottom end of the stem 39 attaches a stem spindle 40 at one end. Another end of the stem spindle is extending out of the plug ring 43 and has a conical end 46 which has a larger outside diameter than the inside diameter of the plug ring 43. The conical end 46 further has an O-ring 42 set thereon.

The outer tube 34 of vacuum valve 30 is disposed in the auxiliary fuel duct (shown by broken lines in FIG. 3) which has a passage B leading to the float chamber 16 and another passage C leading to a vicinity of the butterfly valve 17.

Under normal conditions, the O-ring 42 is spaced from the plug ring 43 so that the passage B and C fluidly communicate with each other. Therefore fuel in the float chamber 16 may flow to the butterfly valve 17 location to achieve the purpose of auxiliary fuel supply. However when air pressure at the third air nozzle 31 is less than the air pressure in the chamber in the head 33, (or pressure at the B passage) by a preset valve (depends on the spring 35), the membrane 36 and clip 37 will be lifted upward. The stem 39 and the conical end 46 will also be lifted and cut off the passage between B and C. Auxiliary fuel supply will be stopped.

Figure 4:
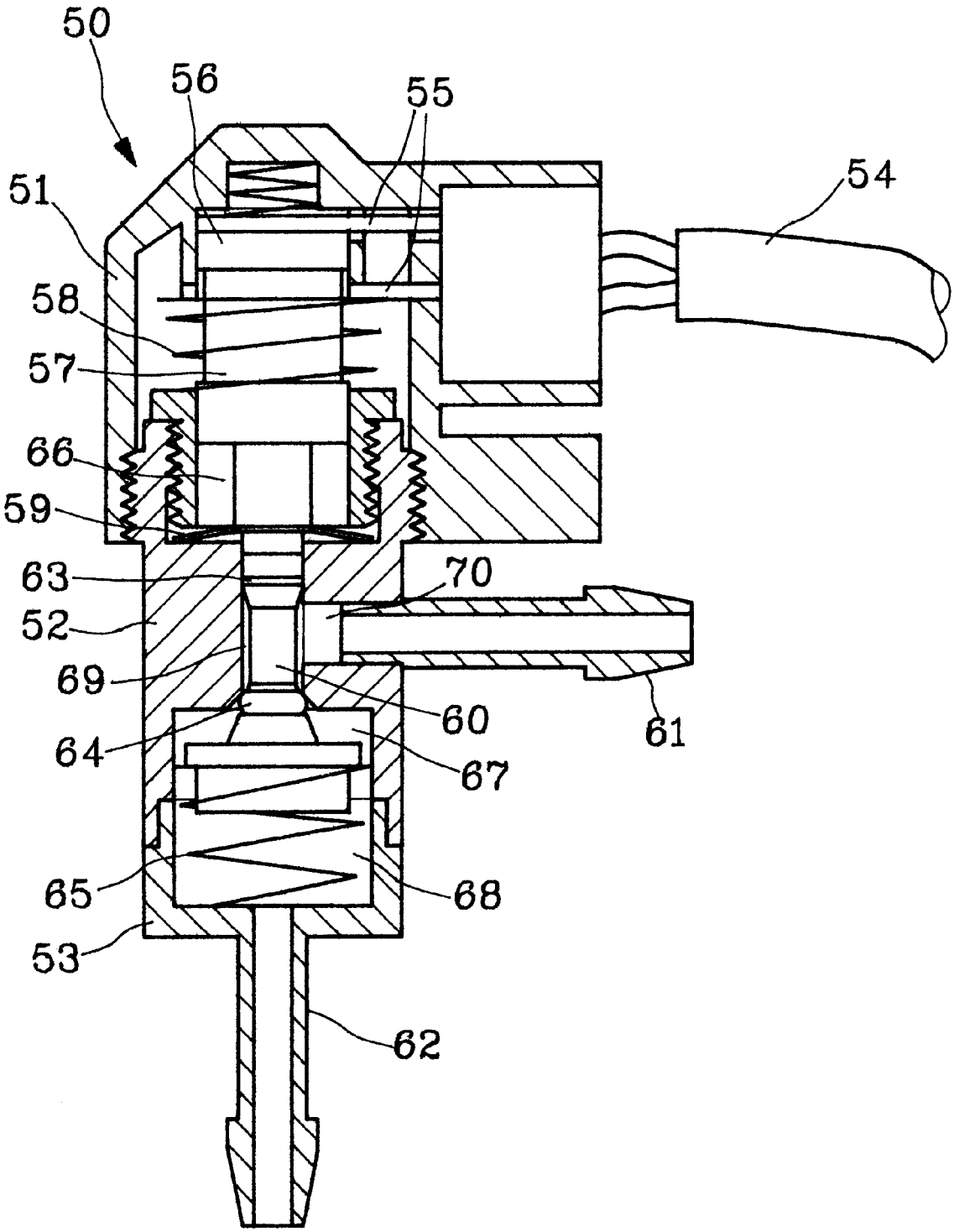
FIG. 4 is a sectional view of a temperature delay vacuum valve of this invention.

Referring to FIG. 4, the temperature delay vacuum valve 50 includes a back seat 51, a front cover 53, a barrel 52 and a piston 60. The back seat 51 includes a pair of electrodes 55, a power line 54, a resistor 56 located between the electrodes 55 and a heat conducting member 57. One end of the heat conducting member making contact of a second spring which is housed within the back seat 51. Another end of the heat conducting member making contact with one side of a curved bimetallic strip 59 located in a first chamber 66 of the barrel 52.

The barrel 52 has its top end engaged with the back seat 51, a second chamber 67 at one end, the first chamber 66 at another end and a center passage 69 in between to connect both chambers 66 and 67. The center passage 69 further fluidly communicates with a first air nozzle 61 from a side wall thereof.

The front seat 53 has its top end engaged with the bottom end of the barrel 52 to form a space 68 under the second chamber 67. The bottom end of the front seat 53 has a second nozzle 62. The piston 60 is moveably housed in the center passage 69 with a pair of spaced O-ring 63 and 64 for sealing against the center passage 69. The top end of the piston 60 makes contact of another side of the bimetallic strip 59 while the bottom end thereof is held by a third spring 65 located in the space 68. The middle section of the piston 60 against the first nozzle 61 is stepped in with a smaller diameter than the center passage 69.

When the engine is at cold start condition and the temperature of the bimetallic strip 59 is below a preset level, the curved bimetallic strip 59 bends upward, the third spring 65 pushes the piston 60 upward and making the O-ring 64 seal the center passage 69 at the bottom end. The passage between the first air nozzle 61 and second air nozzle 62 is cutoff.

When the engine is powered on or starts initially, electric current flows from the electrodes 55 to the resistor 56 and generating heat. That heat flows to the bimetallic strip 59 through the heat conducting member 57. When the temperature of the bimetallic strip 59 reaches a preset valve, the bimetallic strip 59 extends to flatten the curve and consequently push the piston 60 downward. The O-ring 64 will be moved downward to allow the first air nozzle 61 to communicate with the second air nozzle 62. The length of time elapsed between the bimetallic strip 59 receives heat from the charged resistor 56 and bimetallic strip deforms to push the piston 60 is the time delay which the temperature delay vacuum valve 50 is aimed to provide. It can be changed or controlled by selecting desirable resistor 56 (of needed heating parameter), heat conducting member 57 (various size) and bimetallic strip 59 (of required characteristics). The time delay will be shorter in summer and longer in winter, and therefore suits well for engine and vehicle cold start use in all seasons.

Figure 5:
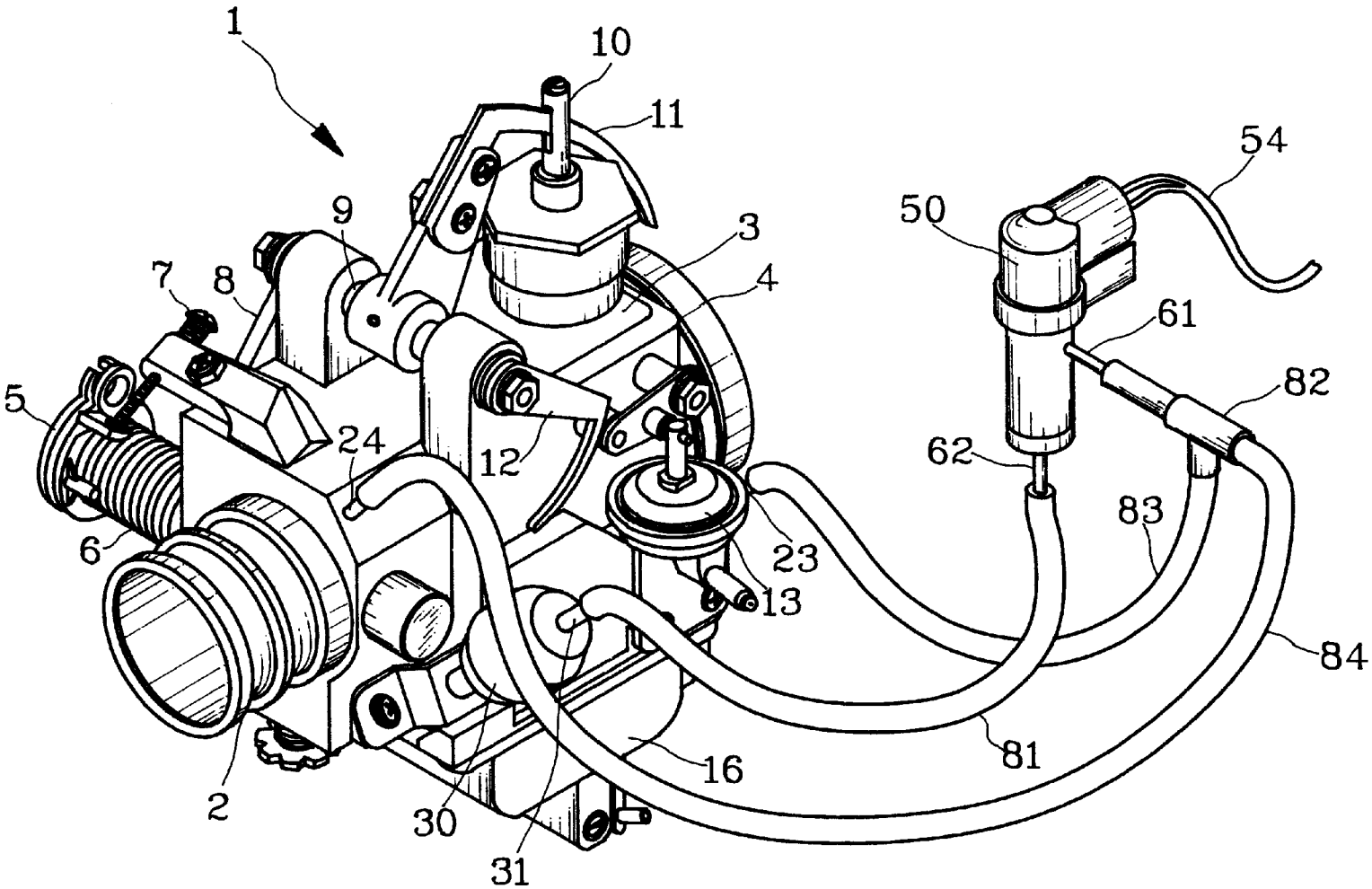
FIG. 5 is a perspective view of a temperature delay vacuum valve coupled with a carburetor.

Referring to FIG. 5, for this invention in use, both the vacuum valve 30 and the temperature delay vacuum valve 50 are installed in the carburetor 1. The vacuum valve 30 controls if the auxiliary fuel duct should supply fuel depends on the pressure (i.e. vacuum degree) at the third air nozzle 31. The first air nozzle 61 of the temperature delay vacuum valve 50 connects with a fourth air nozzle 23 of the carburetor 1 by means of a first pipe 83 leading to the neighborhood of the main throttle 22. The second air nozzle 62 connects with the third air nozzle 31 of the vacuum valve 30 via a second pipe 81 for controlling cold start auxiliary fuel duct opening. Another alternative is to dispose a three-way connector 82 on the first pipe 83 between the fourth air nozzle 23 and the first air nozzle 61 with a third pipe 84 connecting one end of the three-way connector 82 with a fifth air nozzle 24 on the carburetor. The fifth air nozzle 24 leads to the neighborhood of the butterfly valve 17.

When the engine is at cold start condition, the passage between the first air nozzle 61 and the second air nozzle 62 is closed. Once power is on or the engine is started, the electrodes 55 of the temperature delay vacuum valve 50 start to heat the bimetallic strip 59. The vacuum valve 30 is open to supply additional fuel air mixture to the engine. After a preset time period, the temperature of the bimetallic strip 59 reaches a preset degree and changes its curvature, at this point, the engine has already warmed up, the deforming bimetallic strip 59 pushes the piston 60 downward to open the passage between the first air nozzle 61 and the second air nozzle 60. The first air nozzle 61 will then transmit the vacuum pressure (at relatively low pressure level) near the main throttle 22 through the second air nozzle 62 and to the third air nozzle 31 at the vacuum valve 30. The vacuum valve 30 will close the auxiliary fuel duct to save fuel consumption.

The structure set forth above has another advantage as follow. When the engine is running at normal condition and temperature, the passage between the first air nozzle 61 and the second air nozzle 62 remains open. If the driver hits the accelerator abruptly or the loading of the engine increases suddenly (such as climbing a steep slope), the vacuum pressure at the main throttle 22 (or the butterfly valve 17) will drop (i.e. air pressure will increase). The vacuum valve 30 connected to the second air nozzle 62 will open to enable additional fuel gas mixture to enter the engine to increase engine output power. Once the driver stops hitting the accelerator heavily, the cold start auxiliary fuel duct will be closed again.

It thus may be seen that the changeable Venturi carburetor with cold start and high loading auxiliary fuel duct of this invention is able to provide dual function of supplying additional fuel for cold engine and when the accelerator is hit heavily and suddenly.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A changeable Venturi carburetor including a cold start and high loading auxiliary fuel duct comprising:

a carburetor having a front frame, a body, a back seat and a float chamber; the body including at least a changeable Venturi means which has a steel rope wheel and a butterfly valve, and a main fuel duct system which has a main throttle and a fuel pin; and an auxiliary fuel duct including a vacuum valve and a temperature delay vacuum valve engageable with the carburetor, the vacuum valve having at one end a third air nozzle connecting with a first air nozzle in the temperature delay vacuum valve, the temperature delay vacuum valve further having a second air nozzle communicating with the main throttle, the second air nozzle connectable with the first air nozzle for air pressure at vicinity of the main throttle to transmit to the third air nozzle to control the vacuum valve motion and fuel supply of the auxiliary fuel duct.

2. The changeable Venturi carburetor including a cold start and high loading auxiliary fuel duct of claim 1, wherein the third air nozzle connects with the first air nozzle through a first pipe, the carburetor further having a fourth air nozzle connecting to a vicinity of the main throttle, the fourth air nozzle connecting with the second air nozzle through a second pipe.

3. The changeable Venturi carburetor including a cold start and high loading auxiliary fuel duct of claim 2, wherein the second pipe connects with a three-way connector having a third outlet connecting with a third pipe at one end thereof, another end of the third pipe connecting with a fifth air nozzle in the carburetor, the fifth air nozzle communicating with a vicinity of the changeable Venturi means.

4. The changeable Venturi carburetor including a cold start and high loading auxiliary fuel duct of claim 1, wherein the vacuum valve further includes:

a top cover having a top end on which the third air nozzle located;

an outside tube engageable by screwing at one end thereof with the top cover including a membrane covering one end, an axial center bore, an annular groove spaced from another end thereof, and a plural number of spaced O-rings mounted on the outside lateral wall of the outside tube; the membrane having a clip sandwiched at the center thereof from both sides, one side of the clip engaging with a first spring located between the clip and the top cover; the annular groove having at least one air passage communicating with the center bore; and an inner stem having a smaller outside diameter than the inside diameter of the center bore and being moveable in the center bore, a top end engageable with another side of the clip, a bottom end attached to a stem spindle at one end thereof, another end of the stem spindle being extended out of a bottom end of the outside tube and forming a conical end with an O-ring located thereon.

5. The changeable Venturi carburetor including a cold start and high loading auxiliary fuel duct of claim 1, wherein the temperature delay vacuum valve further includes:

a back seat having a heat conducting member and a resistor sandwiched between a pair of electrodes for receiving electricity from a power line to generate heat;

a front seat having a space inside with a third spring located in the space and a second air nozzle at one end thereof communicating with the space;

a barrel engageable at one end thereof with the back seat and at another end with the front seat having a first chamber at one end, a second chamber at another end, a center passage communicating with the first and second chambers, and a branch passage communicating with the center passage and the first air nozzle; the second chamber communicating with the space in the front seat;

a bimetallic strip located in the first chamber having one side thereof making contact with the heat conducting member; and a piston moveably located in the barrel having a top end making contact with another side of the bimetallic strip, a bottom end engaging with the third spring, a center section moveably located in the center passage and having a smaller diameter than the center passage, and a pair of spaced O-rings located on an outside surface between the branch passage thereof, moveably contact with the center passage for preventing the branch passage communicating with the first chamber, and allowing the branch passage communicating with the second chamber under a preset condition.

* * * * *